US008495826B2

(12) United States Patent
Itou et al.

(10) Patent No.: US 8,495,826 B2
(45) Date of Patent: Jul. 30, 2013

(54) WORK IMPLEMENT AND RETAINING PIN ASSEMBLY

(75) Inventors: Daijirou Itou, Hirakata (JP); Kouzou Ishida, Hirakata (JP); Takanori Nagata, Dallas, TX (US); Keita Mutou, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/497,003

(22) PCT Filed: Mar. 30, 2011

(86) PCT No.: PCT/JP2011/058123

§ 371 (c)(1),
(2), (4) Date: May 21, 2012

(87) PCT Pub. No.: WO2011/125794

PCT Pub. Date: Oct. 13, 2011

(65) Prior Publication Data

US 2012/0222336 A1 Sep. 6, 2012

(30) Foreign Application Priority Data

Mar. 31, 2010 (JP) ..... 2010-080003

(51) Int. Cl.
*E02F 9/28* (2006.01)

(52) U.S. Cl.
USPC ..... 37/456

(58) Field of Classification Search
USPC ..... 37/452–459; 403/155, 318, 378; 299/102, 299/103
See application file for complete search history.

(56) References Cited

U.S. PATENT DOCUMENTS

| | | | | |
|---|---|---|---|---|
| 1,808,311 | A * | 6/1931 | Madonna | 37/456 |
| 4,782,607 | A * | 11/1988 | Frisbee et al. | 37/455 |
| 5,009,017 | A * | 4/1991 | Diekevers et al. | 37/456 |
| 5,452,529 | A * | 9/1995 | Neuenfeldt et al. | 37/455 |
| 6,092,958 | A * | 7/2000 | Gale | 403/378 |
| 7,681,341 | B2 | 3/2010 | Ruvang | |
| 2005/0066555 | A1 | 3/2005 | Adamic | |
| 2006/0059732 | A1 | 3/2006 | Clendenning et al. | |
| 2006/0236567 | A1 | 10/2006 | Adamic | |
| 2009/0165339 | A1 | 7/2009 | Watatnabe | |

FOREIGN PATENT DOCUMENTS

| | | | |
|---|---|---|---|
| JP | 2009-150124 | A | 7/2009 |
| WO | WO-2009/020175 | A1 | 2/2009 |

OTHER PUBLICATIONS

International Search Report of corresponding PCT Application No. PCT/JP2011/058123.

* cited by examiner

*Primary Examiner* — Robert Pezzuto
(74) *Attorney, Agent, or Firm* — Global IP Counselors, LLP

(57) ABSTRACT

A work implement includes a ground engaging tool with a first through-hole, an adapter with a second through-hole, a retaining pin, a metal bushing and a metal retainer. The retaining pin is inserted into the first and second through-holes disposed in a state in which the ground engaging tool is in contact with the adapter. The retaining pin is inserted in an inside of an cylindrical member of the bushing, which is disposed at an end portion of the retaining pin inside the first through-hole. The metal retainer prevents the bushing from coming loose from the retaining pin by sandwiching the bushing between the metal retainer and the adapter at the end of the retaining pin. The bushing is disposed in a state that allows movement in an axial direction of the retaining pin between the adapter and the retainer on an outer peripheral face of the retaining pin.

10 Claims, 11 Drawing Sheets

(a)

(b)

WORK IMPLEMENT AND RETAINING PIN ASSEMBLY

CROSS-REFERENCE TO RELATED APPLICATIONS

This application claims priority to Japanese Patent Application No. 2010/080003 filed on Mar. 31, 2010, the disclosure of which is hereby incorporated herein by reference in its entirety.

BACKGROUND OF THE INVENTION

1. Field of the Invention

The present invention relates to a work implement to which a ground engaging tool is connected, and to a pin assembly for retaining this ground engaging tool to the work implement.

2. Description of the Related Art

Various kinds of ground engaging tool are connected to a work implement installed on a hydraulic excavator or other such work vehicle. For example, teeth (ground engaging tool) are retained to the excavation-side distal end portion of a bucket (work implement) installed on a hydraulic excavator.

The teeth retained to the distal end portion of a bucket wear down or break during excavation work. Therefore, worn or broken teeth are replaced as needed.

International Laid-Open Patent Application WO 2009/020175 (international publication on Feb. 12, 2009) discloses a structure in which such teeth are retained to an adapter of a bucket.

More specifically, with the retaining structure disclosed in the above-mentioned literature, retaining pins (first and second retaining pins) are inserted into through-holes formed in the teeth and the adapter of the bucket, and are retained so that the teeth do not fall off the adapter. The male threads of the first retaining pin are then threaded into the female threads of the second retaining pin, so that an elastic member inserted into the hole of the adapter is sandwiched between the first retaining pin and the second retaining pin and compressed in the axial direction and bulge out in the radial direction. This increases the contact of the elastic member against the inner wall face of the hole, so the first and second retaining pins that have been inserted into the through-holes of the adapter and the teeth are prevented from falling out.

SUMMARY

However, the following problems were encountered with the above-mentioned conventional ground engaging tool for a work implement.

Specifically, with the ground engaging tool of the work implement disclosed in the above-mentioned literature, the retaining pin is made up of two members, namely, the first and second retaining pins, and a small diameter portion (uneven surface) is formed at the portion that holds the elastic member. Accordingly, when the teeth are subjected to a large impact during excavation work, etc., there is the risk that stress will concentrate in this uneven surface portion, causing the retaining pin to break.

Furthermore, an elastic member is provided between the first and second retaining pins to prevent the retaining pins from coming loose from the through-holes formed in the teeth and the adapter of the bucket. This elastic member is formed from natural rubber or another such material, so it has low durability against aging degradation, and is not suited to extended use.

It is an object of the present invention to provide a work implement and a retaining pin assembly with which the durability of the retaining pin is improved so that the pin can be used over a longer period.

The work implement pertaining to the first aspect includes a ground engaging tool, an adapter on the work implement side, a retaining pin in the form of a metal rod, a metal bushing, and a metal retainer. The ground engaging tool has a first through-hole and wears down during excavation work. The work implement-side adapter has a second through-hole whose diameter is smaller than that of the first through-hole, and a contact face that comes into contact with the ground engaging tool so as to bear the load exerted during work using the ground engaging tool, and the ground engaging tool is connected thereto. The retaining pin that is in the form of a metal rod is inserted into the first and second through-holes disposed so as to pass through the adapter and the ground engaging tool in a state in which the ground engaging tool is in contact with the adapter. The metal bushing is a cylindrical member having an outside diameter that is larger than the outside diameter of the retaining pin, into which the retaining pin is inserted on the inside of the cylindrical shape, and which is disposed at the end of the retaining pin inside the first through-hole. The metal retainer prevents the bushing from coming loose from the retaining pin by sandwiching the bushing between the metal retainer and the adapter at the end of the retaining pin. The bushing is disposed in a state that allows movement in the axial direction of the retaining pin between the adapter and the retainer on the outer peripheral face of the retaining pin.

With a work implement such as a bucket to which teeth or another such ground engaging tool is connected, retaining pins in the form of a rod with no uneven surface portion are used as the retaining pins inserted into the first and second through-holes that pass through the ground engaging tool and the adapter. The pin assembly (retaining pin, bushing, retainer) that attaches the ground engaging tool to the adapter is one that is made entirely of metal. The bushing provided between the adapter and the retainer is provided in a state that allows movement in the axial direction of the retaining pin along the outer peripheral face of the retaining pin.

The work in which the above-mentioned ground engaging tool is used here includes, for example, excavation work using teeth connected to a bucket or a ripper. That is, this is a structure in which a large load in the direction of pushing the teeth or other such ground engaging tool into the adapter, which is exerted on the ground engaging tool during such work, is borne by faces where the adapter and the ground engaging tool come into contact with each other, and the retaining pin is subjected to almost no load during work.

Conversely, when a load is exerted in the direction of moving the ground engaging tool away from the adapter under its own weight, etc., the ground engaging tool can be prevented from coming loose from the adapter by a retaining pin assembly that includes a retaining pin, a bushing, and a retainer. The load here is usually much smaller than the above-mentioned load encountered during excavation.

Also, the above-mentioned ground engaging tool includes teeth (bucket teeth members), edge protectors, and so forth that are connected to a bucket or ripper. The above-mentioned retainer includes, for example, bolts and other such fastening members having male threads that mesh with the female threads formed on the end of the retaining pin.

Consequently, unlike with the conventional structure discussed above, since there is no uneven surface portion on the retaining pin, even if a force is exerted in the direction of moving the ground engaging tool and the adapter away from each other, for example, the retaining pin can be prevented from breaking at that uneven surface portion. Also, because the members that connect the ground engaging tool and the adapter are made entirely from metal, the durability of the members that make up the ground engaging tool retaining structure have better durability than with the conventional structure discussed above. Furthermore, since the bushing inserted into the retaining pin is able to move between the adapter and the retainer, that is, the bushing is not fixed with respect to the retaining pin or the adapter, the load exerted on the retaining pin from the ground engaging tool via the bushing is reduced by movement of the bushing. As a result, a work implement can be provided which has a ground engaging tool retaining structure that stands up better to extended use than in the past.

The work implement pertaining to the second aspect is the work implement pertaining to the first invention, wherein the bushing is attached rotatably with respect to the retaining pin.

Here, a gap is provided between the outer peripheral face of the rod-shaped retaining pin and the inner peripheral face of the cylindrical bushing, creating a state in which the bushing is able to rotate with respect to the retaining pin.

Consequently, when a load is exerted in the direction of moving the ground engaging tool away from the adapter, that load will be transmitted from the ground engaging tool to the bushing, but the bushing will rotate around the outer periphery of the retaining pin, thereby deflecting part of the load. Thus, even if a load is exerted in the direction of moving the ground engaging tool away from the adapter, the load exerted on the retaining pin can be effectively reduced.

The work implement pertaining to the third aspect is the work implement pertaining to the first or second invention, wherein a first gap is formed between the opposing faces of the adapter and the bushing, which are opposite each other in the axial direction of the retaining pin, or between the opposing faces of the bushing and the retainer.

Here, a specific gap (a first gap) is provided between the opposing faces on the bushing side and the adapter side, which are opposite each other in the axial direction of the retaining pin, or between the opposing faces of the bushing and the retainer. That is, the retaining pin is connected in a state in which there is a gap (play) between the side face of the adapter where the second through-hole is open, or the side face of the retainer, and the opposing face of the bushing.

Consequently, although the retaining pin that has been inserted into the second through-hole of the adapter is not fastened to the side faces of the adapter, the bushing function as a retainer, so the ground engaging tool and the adapter can be connected without any large load being exerted on the retaining pin.

The work implement pertaining to the fourth aspect is the work implement pertaining to any of the first to third inventions, wherein a second gap is formed between the outer peripheral face of the bushing and the inner peripheral face of the first through-hole.

Here, a specific gap (second gap) is provided between the inner peripheral face of the through-hole on the ground engaging tool side and the outer peripheral face of the bushings attached at both ends of the retaining pins inserted into the first and second through-holes that pass through the ground engaging tool and the adapter. That is, the ground engaging tool is attached to the adapter in a state in which there is a specific gap between the ground engaging tool and the bushings.

Consequently, when the teeth or other such ground engaging tool is subjected to impact during excavation work or the like, since that impact force is received by the contact face of the adapter, the retaining pins or bushings are not subjected directly to a large impact force during excavation. Conversely, if a force is exerted in the direction of moving the ground engaging tool away from the adapter, the inner peripheral face of the first through-hole of the ground engaging tool will come into contact with the outer peripheral face of the bushing, preventing the ground engaging tool from falling off of the adapter.

Because of the above, even if an impact force is exerted in some direction on the ground engaging tool, the retaining pin will avoid being subjected to a large load, which effectively prevents the retaining pin from breaking.

The work implement pertaining to the fifth aspect is the work implement work implement pertaining to any of the first to fourth inventions, wherein the retainer has a bolt member and a washer.

Here, a bolt member and a washer are used as the retainer that keeps the bushings from coming loose from the ends of the retaining pin.

Consequently, the bushings can move along the retaining pin between the adapter and the washer by threading the male threads of the bolt member through the washer into the female threads formed in the end of the retaining pin.

The work implement pertaining to the sixth aspect is the work implement work implement pertaining to any of the first to fifth inventions, wherein the ground engaging tool includes a bucket teeth member and an edge protection member.

Here, the face members (teeth) of a bucket or ripper, and the edge protection members (edge protector) of a ripper, bucket, or side shroud are used as the ground engaging tool of a work implement.

Consequently, a structure can be provided which stands up to extended use, by attaching various kinds of ground engaging tool using the above-mentioned retaining structure and thereby improving the durability of the retaining pin.

The retaining pin assembly pertaining to the seventh aspect is a retaining pin assembly provided to prevent a ground engaging tool of a work implement from falling off of an adapter on the work implement side, comprising a retaining pin in the form of a metal rod, a metal bushing, and a metal retainer. The retaining pin in the form of a metal rod is inserted into a first through-hole on the ground engaging tool side and a second through-hole on the adapter side disposed so as to pass through the adapter and the ground engaging tool in a state in which the ground engaging tool is mounted to the adapter. The metal bushing is a cylindrical member having an outside diameter that is larger than the outside diameter of the retaining pin, into which the retaining pin is inserted on the inside of the cylindrical shape, and which is disposed at the end of the retaining pin inside the first through-hole. The metal retainer at the end of the retaining pin prevents the bushing from coming loose from the end of the retaining pin. The bushing is disposed in a state that allows movement in the axial direction of the retaining pin between the adapter and the retainer on the outer peripheral face of the retaining pin.

Here, a rod-shaped retaining pin with no uneven surface portion is used as a retaining pin that is inserted into first and second through-holes that pass through the ground engaging tool and the adapter and that is used in a structure in which teeth or another such ground engaging tool of a bucket will not fall off of the bucket or other such work implement. The retaining pin assembly (retaining pin, bushing, retainer) for connecting the ground engaging tool and the adapter is one that is made entirely of metal.

Here, the above-mentioned ground engaging tool includes teeth (bucket teeth members), edge protectors, or the like connected to a bucket or ripper. The above-mentioned retainer includes, for example, bolts and other such fastening members having male threads that mesh with the female threads formed at both ends of the retaining pin.

The work in which the above-mentioned ground engaging tool is used includes, for example, excavation work using teeth connected to a bucket or ripper. That is, this is a structure in which a large load in the direction of pushing the teeth or other such ground engaging tool into the adapter, which is exerted on the ground engaging tool during such work, is borne by faces where the adapter and the ground engaging tool come into contact with each other, and the retaining pin is subjected to almost no load during work.

Conversely, when a load is exerted in the direction of moving the ground engaging tool away from the adapter under its own weight, etc., the ground engaging tool can be prevented from coming loose from the adapter by a retaining pin assembly that includes a retaining pin, a bushing, and a retainer.

Consequently, unlike with the conventional structure discussed above, since there is no uneven surface portion on the retaining pin, even if a force is exerted in the direction of moving the ground engaging tool and the adapter away from each other, for example, the retaining pin can be prevented from breaking at that uneven surface portion. Also, because the members that connect the ground engaging tool and the adapter are made entirely from metal, the durability of the retaining pin assembly that makes up the ground engaging tool retaining structure has better durability than with the conventional structure discussed above. As a result, when this retaining pin assembly is used, a work implement can be provided which has a ground engaging tool retaining structure that stands up better to extended use than in the past.

DESCRIPTION OF THE EMBODIMENTS

Embodiment 1

A bucket teeth retaining structure employing the work implement pertaining to an embodiment of the present invention will be described below through reference to FIGS. 1 to 4*b*.

Retaining Structure of Teeth 2 of Bucket 1

Figure 1:
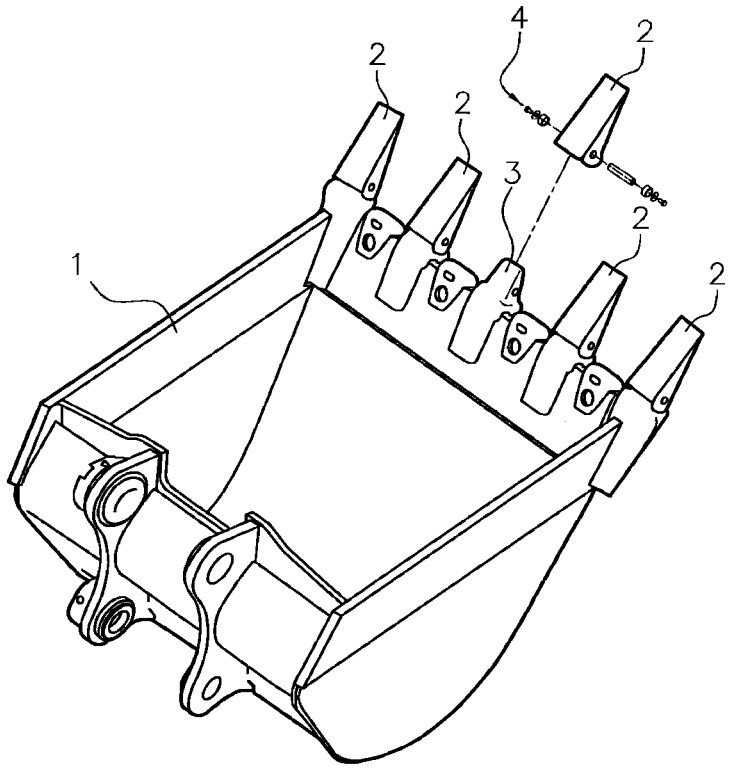
FIG. 1 is an oblique view of a bucket teeth retaining structure pertaining to an embodiment of the present invention.

As shown in FIG. 1, the retaining structure of teeth 2 (bucket teeth members, ground engaging tools) of a bucket 1 (work implement) pertaining to this embodiment is a structure for connecting the teeth 2 to the bucket 1, and each comprises a tooth 2, an adapter 3, and a retaining pin assembly 4.

Tooth 2

Figure 2:
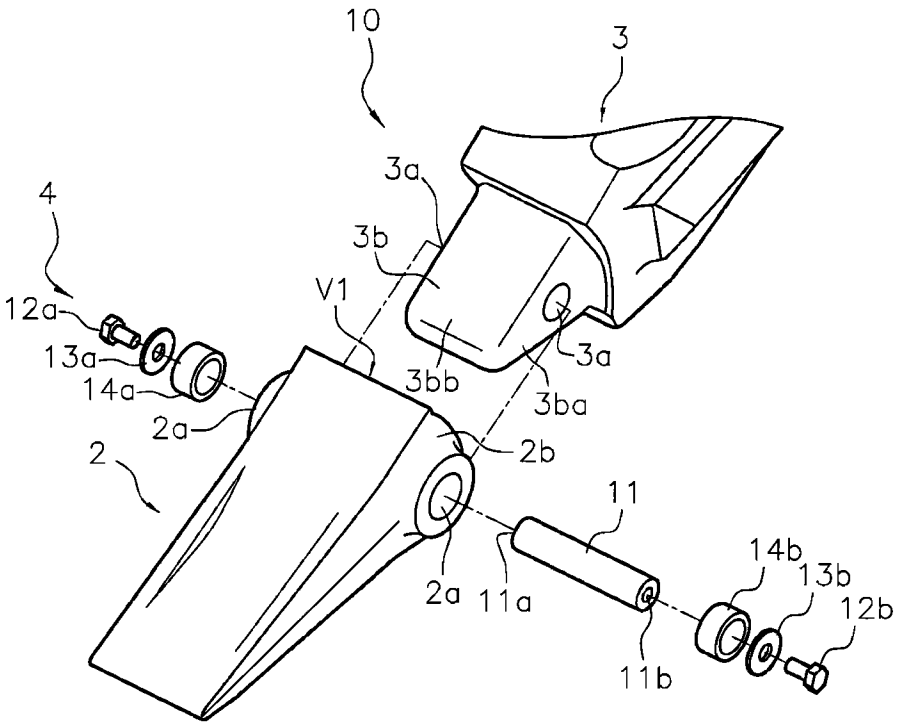
FIG. 2 is an exploded oblique view in which the teeth retaining structure in FIG. 1 is enlarged.
Figure 3:
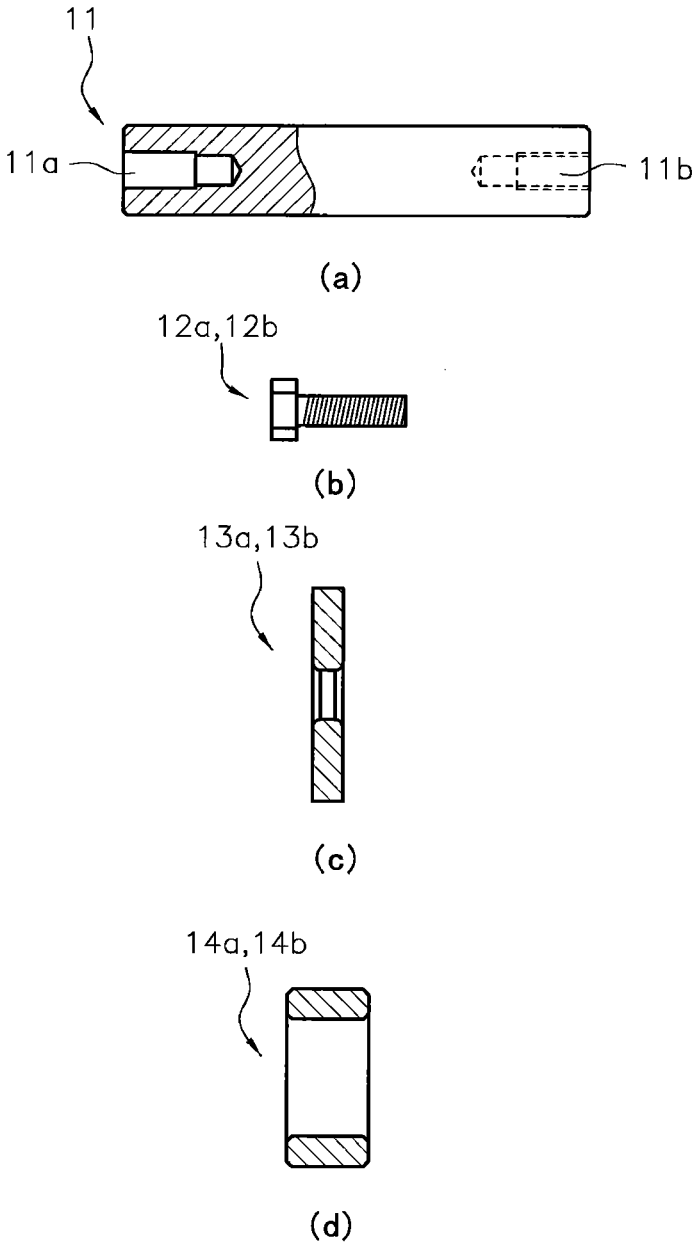
FIG. 3*a* is a side view of the configuration of the retaining pin included in the retaining structure in FIG. 2.
FIG. 3*b* is a side view of the configuration of a bolt.
FIG. 3*c* is a side view of the configuration of a washer.
FIG. 3*d* is a side view of the configuration of a bushing.

The teeth 2 are bucket teeth-shaped members connected to the distal end of the excavation portion of the bucket 1 in order to perform excavation with the bucket 1 mounted to the distal end of an articulated arm of a hydraulic excavator or the like, and as shown in FIG. 1, each tooth has a wedge shape that tapers toward the distal end. As shown in FIG. 2, each tooth 2 has a cavity V1, through-holes (first through-holes) 2*a*, side walls 2*b*, and contact faces 2*c* (see FIG. 4*a*).

The cavity V1 is a convex component formed in the interior of the tooth 2 from the opening at the rear end of the tooth 2 toward the distal end. An insertion component 3*b* of an adapter 3 (discussed below) is inserted into this cavity V1. The cavity V1 has a wedge shape that becomes thinner toward the distal end, just as with the above-mentioned tooth 2.

The through-holes 2*a* pass from a side face of the tooth 2 to the cavity V1, and are formed in a direction that is perpendicular to the lengthwise direction of the tooth 2 (the direction linking the rear end and distal end of the tooth 2). A retaining pin assembly 4 (discussed below) is inserted into these through-holes 2*a*. The through-holes 2*a* each have an inside diameter that is slightly larger than the outside diameter of bushings 14*a* and 14*b* of the retaining pin assembly 4 (discussed below).

The side walls 2*b* are formed on the side faces of the cavity V1 formed in the interior of the tooth 2, and the above-mentioned through-holes 2*a* are formed therein. The periphery around where the through-holes 2*a* are formed in the side walls 2*b* is in the form of a boss that protrudes from the side walls 2*b*.

As shown in FIG. 4*a*, the contact faces 2*c* are the inner wall faces that form the cavity V1 inside the tooth 2, and come into contact with contact faces 3*bb* on the adapter 3 (discussed below) side.

Adapter 3

As shown in FIG. 1, a plurality of the adapters 3 are provided at one end of the bucket 1, and one of the above-mentioned teeth 2 is attached to each adapter. As shown in FIG. 2, the adapters 3 each have through-holes (second through-holes) 3*a* and an insertion component 3*b*.

The through-hole 3*a* passes through the adapter 3 in the width direction, and is formed in side walls 3*ba* of the insertion component 3*b*. Just as with the above-mentioned through-holes 2*a*, the retaining pin assembly 4 (discussed below) is inserted into this through-hole 3*a*. The through-hole 3*a* has an inside diameter that is larger than the outside diameter of a retaining pin 11 of the retaining pin assembly 4 (discussed below) by enough to allow play. Accordingly, the inside diameter is smaller than that of the above-mentioned through-holes 2*a*.

The insertion component 3*b* is formed to match the concave shape of the cavity V1 formed in the tooth 2, and is inserted into the cavity V1 of the tooth 2. Also, when it is inserted into the cavity V1 of the tooth 2, the insertion component 3*b* comes into contact at the contact faces 3*bb* with the contact faces 2*c* provided on the inner wall face sides of the tooth 2 forming the cavity V1. This connecting state of the tooth 2 is called a contact state.

As shown in FIG. 4*a*, the contact faces 3*bb* are the outer wall faces of the insertion component 3*b* that come into contact with the contact faces 2*c* on the tooth 2 side in a state in which the tooth 2 has been connected (contact state).

Retaining Pin Assembly 4

The retaining pin assembly 4 is a member for connecting the tooth 2 so that it will not fall off of the adapter 3, and as shown in FIG. 2, it is inserted into the through-holes 2*a* on the tooth 2 side and the through-hole 3*a* on the adapter 3 side in a state in which the tooth 2 has been connected to the adapter 3. As shown in FIG. 2, the retaining pin assembly 4 has a retaining pin 11, bolts (retainers) 12*a* and 12*b*, washers (retainers) 13*a* and 13*b*, and bushings 14*a* and 14*b*.

As shown in FIG. 3*a*, the retaining pin 11 is a straight metal pin in the form of a rod with no uneven surface, and female threads 11*a* and 11*b* are formed at both ends. The axial direction length of the retaining pin 11 is greater than the sum of the length of the through-hole 3*a* of the adapter 3 and the length of the two bushings 14*a* and 14*b*.

As shown in FIG. 3*b*, the bolts 12*a* and 12*b* are metal fastening members having an ordinary shape, and their male threads mesh with the female threads 11*a* and 11*b* formed at both ends of the retaining pin 11.

As shown in FIG. 3*c*, the washers 13*a* and 13*b* are metal members that are substantially disk shaped and have an outside diameter that is larger than the outside diameter of the retaining pin 11, and a through-hole for inserting the bolts 12*a* and 12*b* is formed in their center. These washers are fixed at the end faces of the retaining pin 11 by the bolts 12*a* and 12*b*, and are provided so that the bushings 14*a* and 14*b* will not come loose from the retaining pin 11.

As shown in FIG. 3*d*, the bushings 14*a* and 14*b* are metal members that are substantially rod-shaped, and have a through-hole for inserting the retaining pin 11 formed in their center. These bushings are provided to the ends of the retaining pin 11 by means of the bolts 12*a* and 12*b* and the washers 13*a* and 13*b*. The inside diameter of the bushings 14*a* and 14*b* is larger than the outside diameter of the retaining pin 11 so that the retaining pin 11 can be inserted with play, and is smaller than the outside diameter of the washers 13*a* and 13*b*. Accordingly, the bushings 14*a* and 14*b* are able to rotate on the outer peripheral face of the retaining pin 11, and are able to move between the adapter 3 and the washers 13*a* and 13*b*.

The retaining pin assembly 4 in this embodiment is constituted as above, and when it is inserted into the through-holes 2*a* and 3*a* that pass through the tooth 2 and the adapter 3, the tooth 2 is attached to the adapter 3 so that it will not fall off.

If the teeth 2 should be subjected to an impact during excavation work using the bucket 1 on a hydraulic excavator or the like, that impact force will act in the direction of pushing the teeth 2 in toward the adapter 3 side. At this point, the impact force imparted to the teeth 2 is received at the outer wall faces (contact faces 3*bb*) of the insertion component of the adapter 3 from the contact faces 2*c* that form the cavity V1 inside each tooth 2. Thus, impact force imparted to the teeth 2 during excavation work or the like does not act on the retaining pin assembly 4 that connects the teeth 2 and the adapters 3. This is because a gap is provided between the inner wall faces of the through-holes 2*a* of the teeth 2 and the outer peripheral faces of the bushings 14*a* and 14*b*.

In other words, with this embodiment, the retaining pin assembly 4 functions only as a retainer that keeps the tooth 2 from falling off of the adapter 3 when a force is imparted in the direction of moving the tooth 2 away from the adapter 3.

Connecting Structure of Teeth 2

The structure for connecting the teeth 2 using the various members discussed above will now be described in further detail.

As shown in FIG. 4*b*, the retaining pin assembly 4 is inserted into the through-holes 2*a* and the through-hole 3*a* passing through the tooth 2 and the adapter 3 in the width direction, in a state in which the insertion component 3*b* of the adapter 3 is inserted into the cavity V1 formed inside the tooth 2, and the adapter 3 is in contact with the inner wall faces of the cavity V1 (contact state).

The procedure for connecting the retaining pin assembly 4 is as follows.

First, the retaining pin 11 is inserted into the center hole of the bushing 14*b*, after which the bolt 12*b* is fixed through the washer 13*b* to one end of the retaining pin 11. At this point, the bolt 12*b* meshes with the female threads 11*b* formed at one end of the retaining pin 11.

Next, the retaining pin 11 is inserted from the other end into the through-hole 2*a* on the tooth 2 side and the through-hole 3*a* on the adapter 3 side.

Next, the other end of the retaining pin 11 that has come out on the opposite side from the insertion side of the tooth 2 is inserted into the center hole of the bushing 14*a*. The bushings 14*a* and 14*b* are provided in a state of being able to rotate with respect to the retaining pin 11. The bolt 12*a* is then fixed through the washer 13*a* to the other end of the retaining pin 11. At this point the bolt 12*a* meshes with the female threads 11*a* formed at the other end of the retaining pin 11.

Consequently, as shown in FIG. 4*b*, the bushings 14*a* and 14*b* are disposed at positions that are away from the inner peripheral faces of the through-holes 2*a* inside the through-holes 2*a* on the tooth 2 side, and are disposed on the outside of the side walls 3*ba* on both sides of the adapter 3. This keeps the retaining pin assembly 4, which is used to prevent the tooth 2 from falling off, from falling out of the through-holes 2*a* and 3*a*.

Also, with the retaining structure for the tooth 2 in this embodiment, in the retaining state of the tooth 2 in which the retaining pin assembly 4 has been inserted as shown in FIG. 4*b*, a specific gap (first gap) S1 is formed between the mutually opposing faces of the side walls 3*ba* of the adapter 3 and the bushings 14*a* and 14*b*. Furthermore, a gap (second gap) S2 is formed between the inner peripheral faces of the through-holes 2*a* and the outer peripheral faces of the bushings 14*a* and 14*b*.

That is, the retaining pin assembly 4 is such that although the right and left bushings 14*a* and 14*b* are disposed sandwiching both side walls 3*ba* of the adapter 3, the bushings 14*a* and 14*b* do not come into contact with the side walls 3*ba*, and are provided with some play in the width direction of the retaining pin 11. Furthermore, the outer peripheral faces of the substantially cylindrical bushings 14*a* and 14*b* are opposite the inner peripheral faces of the through-holes 2*a* of the tooth 2 via the gap S2 (play) in the radial direction. The gap S2 here is large enough to allow the tooth 2 to be loosely attached, and is larger than the gap S1.

Accordingly, when an impact force is imparted to the tooth 2 during excavation work or the like, for example, the force is imparted to the tooth 2 in the direction of the adapter 3. At this point the impact force is transmitted from the contact faces 2*c* on the tooth 2 side where the tooth 2 and the adapter 3 are touching, and is received by the contact faces 3*bb* on the insertion component 3*b* side of the adapter 3. Since the tooth 2 and the retaining pin assembly 4 are not in contact here, the impact force is not imparted to the retaining pin assembly 4.

Meanwhile, if for some reason a force should be imparted in the direction of moving the tooth 2 away from the adapter 3, relative movement of the tooth 2 with respect to the adapter 3 will cause the inner peripheral faces of the through-holes 2*a* of the tooth 2 to come into contact with the outer peripheral faces of the bushings 14*a* and 14*b* of the retaining pin assembly 4. At this point part of the force imparted from the tooth 2 to the bushings 14*a* and 14*b* is effectively deflected. Thus, even if a force is transmitted from the tooth 2 to the outer peripheral faces of the bushings 14*a* and 14*b*, the retaining pin 11 will not be subjected to a large load.

In this embodiment, as discussed above, with a connecting structure for the tooth 2 featuring the retaining pin assembly 4 that is inserted into the through-holes 2*a* and 3*a* that pass through the tooth 2 and the adapter 3, a straight metal pin (retaining pin 11) with no uneven surface is used as a member constituting the retaining pin assembly 4 for fixing the tooth 2 so that it will not be knocked off by a force acting in the direction of moving the tooth 2 away from the adapter 3. Also, members made entirely of metal are used as the bushings 14*a* and 14*b*, the bolts 12*a* and 12*b*, and the washers 13*a* and 13*b* for keeping this retaining pin 11 from falling out of the through-holes 2*a* and 3*a*. Further, the bushings 14*a* and 14*b* are able to move in the axial direction between the adapter 3 and the washers 13*a* and 13*b* along the retaining pin 11, and are able to rotate around the axis of the retaining pin 11.

Consequently, a large impact imparted to the tooth 2 during excavation work is not imparted to the retaining pin assembly 4, and because the retaining pin 11 is in the form of a straight pin that has no uneven surface portion where stress would accumulate locally, as is the case with a conventional retaining pin assembly, the retaining pin 11 can be prevented from breaking.

Also, since there is no member in the retaining pin assembly 4 that undergoes a great deal of aging degradation, such as an elastic member, the retaining pin assembly 4 will have a longer service life than in the past, and can be used for extended periods.

Embodiment 2

A ripping apparatus (work implement) 20 in which the work implement pertaining to another embodiment of the present invention is employed will now be described through reference to FIGS. 5 to 7.

Figure 5:
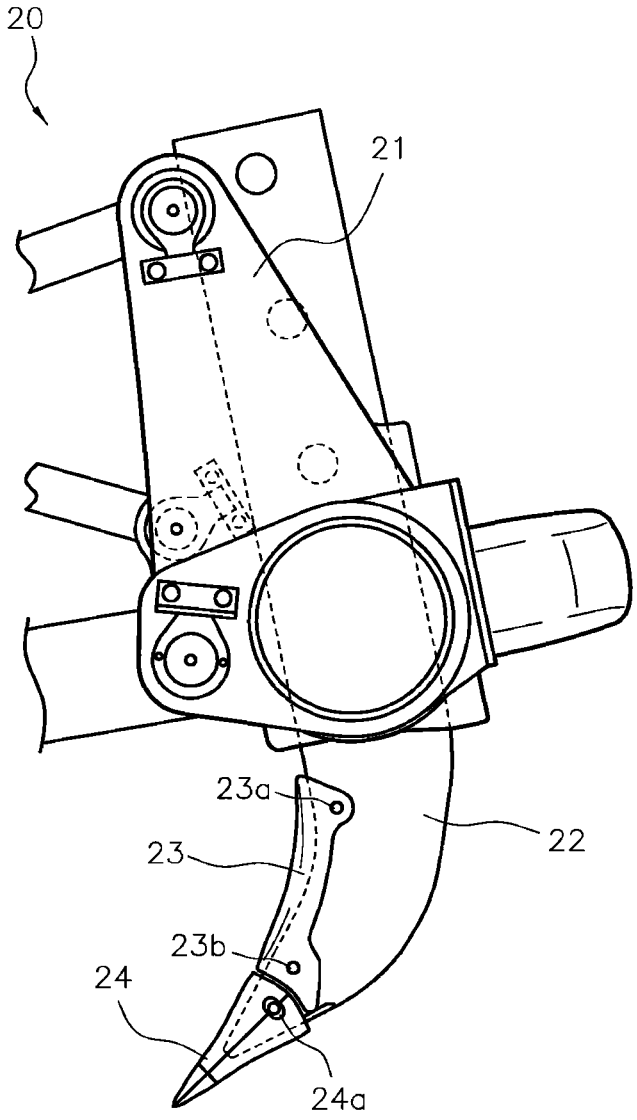
FIG. 5 is an oblique view of a ripper tooth retaining structure pertaining to another embodiment of the present invention.

The ripper apparatus 20 of this embodiment is a digging work implement provided to the rear side of a bulldozer or other such working machine, and as shown in FIG. 5, comprises a beam 21, a jack (adapter) 22, a protector (protection member, ground engaging tool) 23, and a ripper tip (bucket teeth member, ground engaging tool) 24.

The beam 21 is connected to the chassis of the bulldozer, etc., and when a hydraulic cylinder (not shown) is driven, the distal end portion (ripper tip 24) of the ripping apparatus 20 is rotated (tilted) to bring it into contact with or move it away from the ground.

Figure 6:
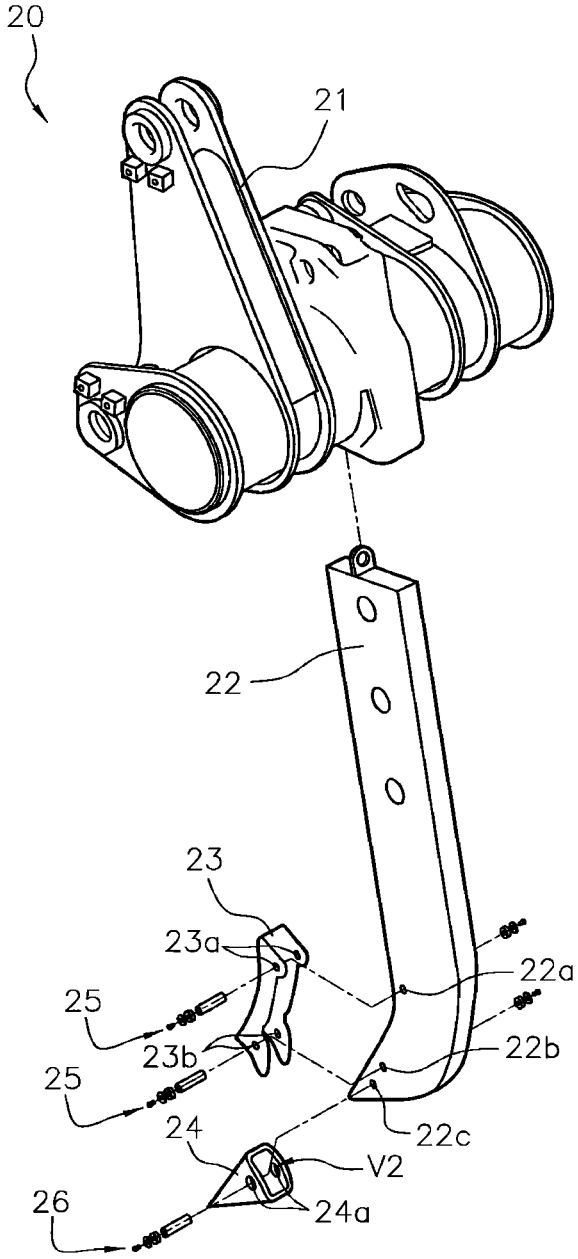
FIG. 6 is an exploded oblique view in which the teeth retaining structure in FIG. 5 is enlarged.

As shown in FIG. 6, the jack 22 is a flat member attached to the beam 21, and has a pointed shape that is curved at the distal end portion on the excavation side. The protector 23 and the ripper tip 24 are attached to the distal end portion of the jack 22.

As shown in FIG. 6, the protector 23 is a member that protects the curved portion of the jack 22 at the face on the inside of the curve, and the upper and lower ends are fixed by retaining pin assemblies 25.

As shown in FIG. 6, the ripper tip 24 is a member that covers the pointed distal end part at the curved portion of the jack 22, and if it should wear down or break during excavation work or the like, it is replaced as a ground engaging tool. The ripper tip 24 is fixed to the distal end portion of the jack 22 by a retaining pin assembly 26.

As shown in FIG. 6, the retaining pin assemblies 25 have the same configuration as the retaining pin assembly 4 in Embodiment 1 above, and are attached by being inserted into through-holes 22*a*, 22*b*, 23*a*, and 23*b* that pass through the jack 22 and the protector 23 at two places.

As shown in FIG. 6, the retaining pin assembly 26 has the same configuration as the retaining pin assembly 4 in Embodiment 1 above, and is attached by being inserted into through-holes 22*c* and 24*a* that pass through the jack 22 and the ripper tip 24.

Because they have substantially the same configuration, the above-mentioned retaining pin assemblies 25 and 26 will be described here using the retaining pin assembly 26 on the ripper tip 24 side as an example.

Figure 7:
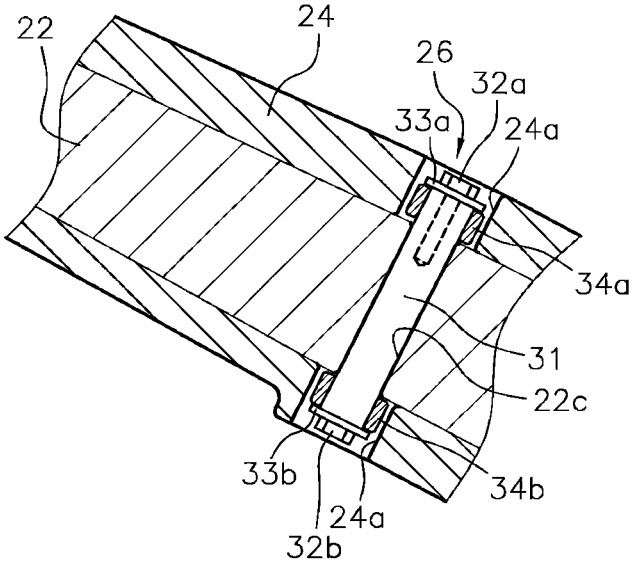
FIG. 7 is a cross section of the tooth retaining structure portion in FIG. 6.

As shown in FIG. 7, the ripper tip 24 has a cavity V2 formed in its interior, from the rear end toward the distal end. When the ripper tip 24 is attached to the distal end portion of the jack 22, the pointed distal end portion of the jack 22 is inserted into and fixed in this cavity V2. At this point the faces that constitute the distal end portion of the jack 22 are in contact with the inside of the cavity V2 of the ripper tip 24.

The retaining pin assembly 26 is a member used for retaining the ripper tip 24 so that it will not fall off of the jack 22, and as shown in FIG. 7, it is inserted into the through-hole 24*a* on the ripper tip 24 side and the through-hole 22*c* on the jack 22 side in a state in which the ripper tip 24 has been attached to the jack 22. The retaining pin assembly 26 has a retaining pin 31, bolts (retainers) 32*a* and 32*b*, washers (retainers) 33*a* and 33*b*, and bushings 34*a* and 34*b*.

The retaining pin 31, the bolts 32*a* and 32*b*, the washers 33*a* and 33*b*, and the bushings 34*a* and 34*b* have the same functions as the retaining pin 11, the bolts 12*a* and 12*b*, the washers 13*a* and 13*b*, and the bushings 14*a* and 14*b* in Embodiment 1 above, and will therefore not be described again here.

Just as in Embodiment 1 above, gaps are formed between the outer peripheral faces of the bushings 34*a* and 34*b* and the inner peripheral face of the through-hole 24*a*, and between the mutually opposing faces of the jack 22 and the bushings 34*a* and 34*b*.

The retaining pin assembly 26 in this embodiment has the above configuration, and is inserted into the through-holes 22*c* and 24*a* that pass through the ripper tip 24 and the jack 22, which attaches the ripper tip 24 to the jack 22 so that the former will not fall off.

If the ripper tip 24 should be subjected to an impact during digging work or the like using the ripping apparatus 20 on a bulldozer, etc., this impact force will act in the direction of pushing the ripper tip 24 in toward the jack 22 side. The impact force imparted to the ripper tip 24 here is received by the outer wall face of the inserted portion of the jack 22 from the contact faces that form the cavity V2 inside the ripper tip 24. Thus, the impact force imparted to the ripper tip 24 during excavation work or the like will not act on the retaining pin assembly 26 that connects the ripper tip 24 and the jack 22.

In other words, in this embodiment, the retaining pin assembly 26 functions only as a retainer that keeps the ripper tip 24 from falling off of the jack 22 when a force is imparted in the direction of moving the ripper tip 24 away from the jack 22.

Because of the above, the same effect as in Embodiment 1 above can be obtained with a connecting structure for the ripper tip 24 that features the retaining pin assembly 26 of this embodiment.

Also, the same effect as in Embodiment 1 above can be obtained with a connecting structure for the protector 23 that features the retaining pin assemblies 25 having the same configuration.

Embodiment 3

A bucket (work implement) 50 in which a work implement pertaining to another embodiment of the present invention is employed will now be described through reference to FIGS. 8 to 9*b*.

Figure 8:
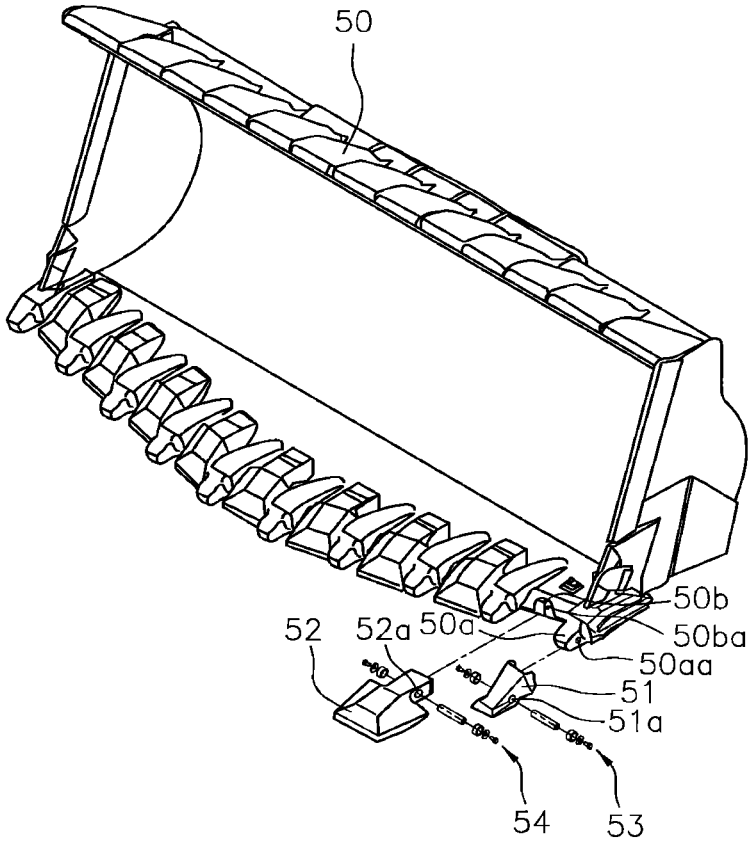
FIG. 8 is an oblique view of the retaining structure for an inter-tooth protector of a bucket pertaining to yet another embodiment of the present invention.
Figure 9:
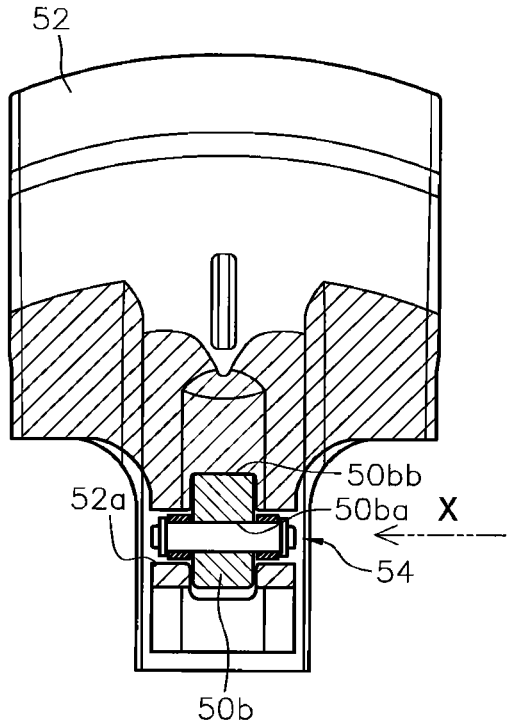
FIG. 9*a* is a detail cross section of the area near the retaining structure of the inter-tooth protector in FIG. 8.
FIG. 9*b* is a side view seen in the X direction of FIG. 9*a;*
Figure 9:
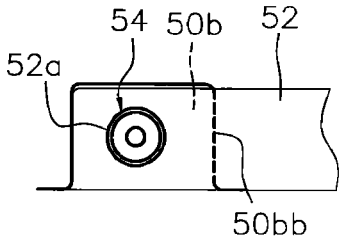

The bucket 50 of this embodiment is a work implement that is mounted to the front portion of a bulldozer, wheel-loader, or other such work machine, and as shown in FIG. 8, a plurality of teeth (bucket teeth members, ground engaging tools) 51 and a plurality of inter-tooth protectors (protection members, ground engaging tools) 52 are attached to the distal end of the excavation portion.

The teeth 51 are bucket teeth members attached to the distal end portion of the bucket 50 in order to perform excavation work, and have a cavity in their interior just as do the teeth 2 in Embodiment 1 above. Insertion components 50*a* formed at the distal end portion of the bucket 50 are inserted into the cavities inside the teeth 51. The teeth 51 are fixed to the insertion components 50*a* by inserting retaining pin assemblies 53 into through-holes 50*aa* and 51*a* that pass through the teeth 51 and the insertion components 50*a*.

The inter-tooth protectors 52 are connected between the various teeth 51, serve to protect the edge portion of the bucket 50, and have an interior cavity just as do the teeth 2 in Embodiment 1 above. Insertion components 50*b* formed at the distal end portion of the bucket 50 are inserted into the cavities inside the inter-tooth protectors 52. The inter-tooth protectors 52 are fixed to the insertion components 50*b* by inserting retaining pin assemblies 54 into through-holes 50*ba* and 52*a* that pass through the inter-tooth protectors 52 and the insertion components 50*b*.

The retaining pin assemblies 53 and 54 have substantially the same configuration as the retaining pin assembly 4 in Embodiment 1 above, and therefore will be described here by using the retaining pin assemblies 54 on the inter-tooth protector 52 side as an example.

The retaining pin assemblies 54 are members that fix the inter-tooth protectors 52 so that they will not fall off of the distal end portion of the bucket 50, and as shown in FIG. 9*a*, they are inserted into the through-holes 52*a* on the inter-tooth protector 52 side and the through-holes 50*ba* on the insertion component 50*b* side in a state in which the inter-tooth protectors 52 have been attached to the insertion components 50*b*. As shown in FIG. 9*b*, the insertion components 50*b* protrude upward from the bottom face of the bucket 50. As shown in FIG. 9*a*, the inter-tooth protectors 52 come into contact with the side faces 50*bb* on the attachment side of the insertion components 50*b*. Consequently, any impact force imparted to the inter-tooth protectors 52 during excavation work or the like is received by the side faces 50*bb* of the insertion components 50*b*, and almost none of it is transmitted to the retaining pin assemblies 54.

Also, if an external force during excavation work or the like should move the inter-tooth protectors 52 away from the insertion components 50*b* and cause the protectors 52 to collide with the insertion components 50*b*, part of this external force will be deflected by the rotation of the bushings. Thus, the external force imparted to the retaining pin assemblies 54 can be effectively reduced.

The retaining pin assemblies 54 have the same configuration as in Embodiments 1 and 2 above.

Since the retaining pin assemblies 54 have the same configuration as the retaining pin assemblies 4, 25, and 26 in Embodiments 1 and 2 above, they will not be described again here. The same applies to the retaining pin assemblies 53.

Because of the above, the same effect as in Embodiment 1 above can be obtained with a retaining structure for the inter-tooth protectors 52 that features the retaining pin assemblies 54 of this embodiment.

Also, the same effect as in Embodiment 1 above can be obtained with a retaining structure for the teeth 51 that features the retaining pin assemblies 53 having the same configuration.

Other Embodiments

Embodiments of the present invention were given above, but the present invention is not limited to or by the above embodiments, and various modifications are possible without departing from the gist of the invention.

(A) In Embodiments 1, 2, and 3 above, an example was described in which the present invention was applied to a work implement comprising a retaining structure for the teeth of a hydraulic excavator bucket, the ripper tips and protectors of a bulldozer, and teeth and inter-tooth protectors of a bucket, and other such ground engaging tools. However, the present invention is not limited to this.

Figure 10:
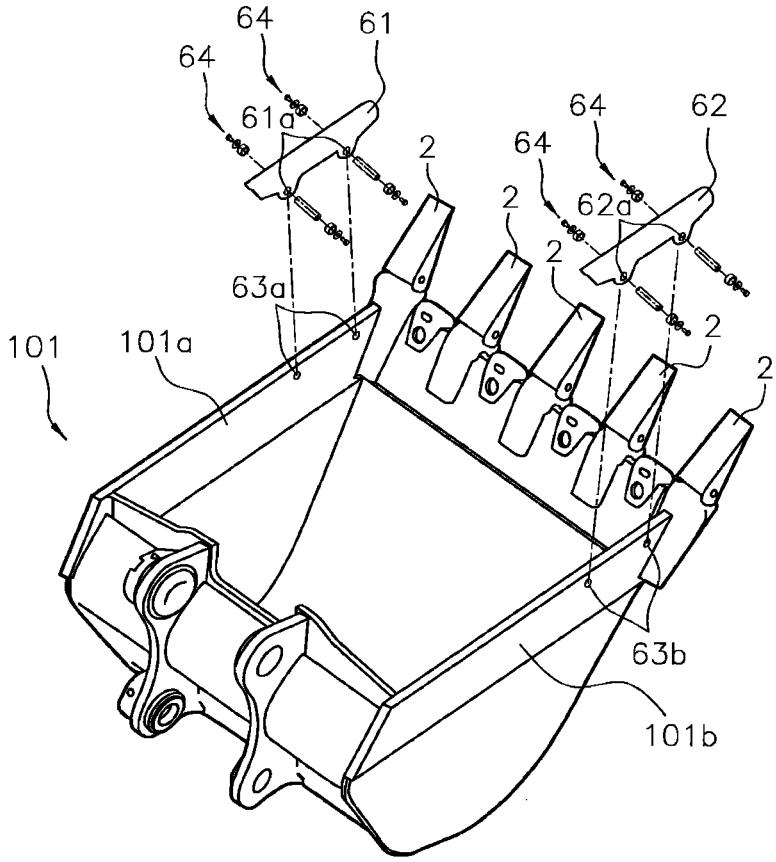
FIG. 10 is an oblique view of the retaining structure for a side shroud of a bucket pertaining to yet another embodiment of the present invention.

For instance, as shown in FIG. 10, the present invention can also be applied to a retaining structure for side shrouds (protection members, ground engaging tools) 61 and 62 of a bucket 101 of a hydraulic excavator.

The side shrouds 61 and 62 are members that protect the edge portions of the bucket 101 attached closer to the excavation side on side faces 101*a* and 101*b* of the bucket 101.

The side shroud 61 is fixed at two places by inserting retaining pin assemblies 64 into through-holes 61*a* and 63*a* that pass through the side face 101*a* of the bucket 101 and the side shroud 61.

Similarly, the side shroud 62 is fixed at two places by inserting retaining pin assemblies 64 into through-holes 62*a* and 63*b* that pass through the side face 101*b* of the bucket 101 and the side shroud 62.

Here, the retaining pin assemblies 64 have the same configuration as the retaining pin assembly 4, etc., described in Embodiments 1, 2, and 3 above.

Consequently, the same effect as in Embodiment 1 above can be obtained when the present invention is applied to a retaining structure for the side shrouds 61 and 62 of the bucket 101.

(B) In the above embodiments, an example was described in which bolts and washers that were separate members were used as retainers, but the present invention is not limited to this.

For instance, a bolt with an integrated washer may be used as a retainer.

Figure 11:
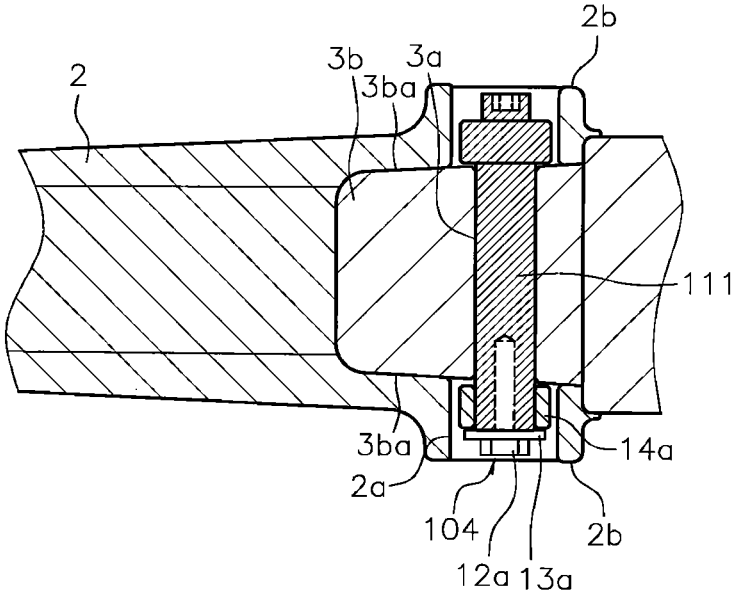
FIG. 11 is a cross section of the configuration of the bucket tooth retaining structure pertaining to another embodiment of the present invention.

Alternatively, as shown in FIG. 11, a retaining pin assembly 104 may be used in which the bolt 12*a*, the washer 13*a*, and the bushing 14*a* at one end are separate members, and a part 111 in which these members are integrated with a retaining pin is used at the other end.

(C) In the above embodiments, an example was described in which the gap between a bushing and a ground engaging tool had a uniform size in the circumferential direction of the cylindrical bushing in a state in which the ground engaging tool had been connected to the adapter, but the present invention is not limited to this.

Figure 4:
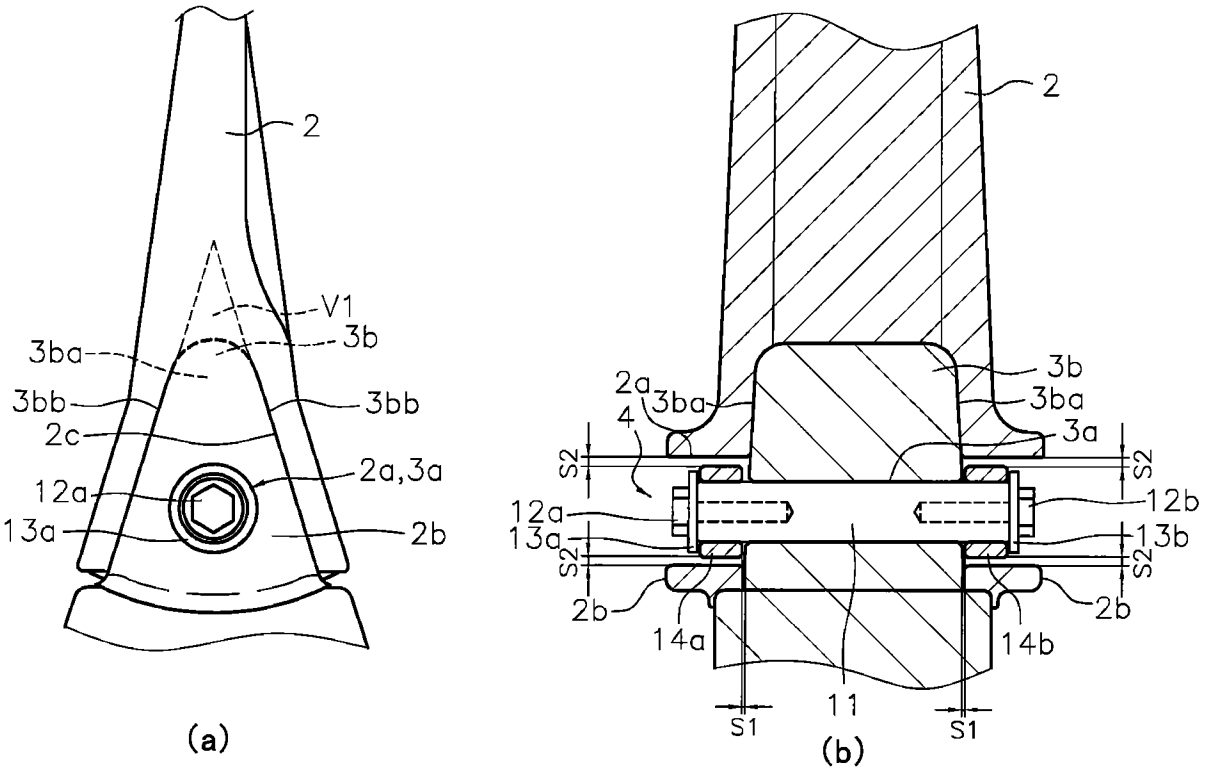
FIGS. 4*a* and 4*b* are a side view and a cross section of the configuration of the teeth retaining structure in FIG. 2.

As shown in FIG. 4, in Embodiment 1 above, the gap S2 between the inner wall faces of the through-holes 2*a* of the tooth 2 and the outer peripheral faces of the bushings 14*a* and 14*b* was uniform in the circumferential direction.

In contrast, for example, the gap (the upper side in FIG. 4*b*) between the inner wall faces at the tooth distal end side of the through-hole and the bushing may be twice the size of the gap S2, and the gap on the proximal end side of the tooth (the adapter side; the lower side in FIG. 4*b*) may be eliminated.

The work implement according to any of the illustrated embodiments can achieve an advantageous effect of standing up better to extended use than in the past. Therefore, the present invention can be widely applied to the structure of a large variety of ground engaging tools.

The invention claimed is:

1. A work implement adapted to be mounted to a work vehicle in order to perform excavation work, comprising:

a ground engaging tool that has a first through-hole and wears down during excavation work;

a work implement-side adapter to which the ground engaging tool is attached and which has a second through-hole whose diameter is smaller than that of the first through-hole, and a contact face that comes into contact with the ground engaging tool so as to bear a load exerted during work using the ground engaging tool;

a retaining pin that is inserted into the first and second through-holes disposed so as to pass through the adapter and the ground engaging tool in a state in which the ground engaging tool is in contact with the adapter, the retaining pin being a metal rod;

a metal bushing that is a cylindrical member having an outside diameter that is larger than an outside diameter of the retaining pin, the retaining pin being inserted in an inside of the cylindrical member, which is disposed at an end portion of the retaining pin inside the first through-hole; and a metal retainer that prevents the bushing from coming loose from the retaining pin by sandwiching the bushing between the metal retainer and the adapter at the end of the retaining pin, wherein the bushing is disposed in a state that allows movement in an axial direction of the retaining pin between the adapter and the retainer on an outer peripheral face of the retaining pin.

2. The work implement according to claim 1, wherein the bushing is attached rotatably with respect to the retaining pin.

3. The work implement according to claim 1, wherein a first gap is formed between opposing faces of the adapter and the bushing, which are facing each other in the axial direction of the retaining pin, or between opposing faces of the bushing and the retainer, which are facing each other in the axial direction of the retaining pin.

4. The work implement according to claim 1, wherein a second gap is formed between an outer peripheral face of the bushing and an inner peripheral face of the first through-hole.

5. The work implement according to claim 1, wherein the retainer has a bolt member and a washer.

6. The work implement according to claim 1, wherein the ground engaging tool includes a bucket teeth member and an edge protection member.

7. The work implement according to claim 1, wherein the retaining pin is a metal rod having an even external circumferential surface.

8. The work implement according to claim 1, wherein the first through hole is formed to pass from a side face of the ground engaging tool in a direction that is perpendicular to a lengthwise direction of the ground engaging tool, and the second through hole is formed to pass in a widthwise direction of the work implement-side adapter.

9. The work implement according to claim 5, wherein an internally threaded hole extending in an axial direction of the retaining pin is formed an axially-facing end of the retaining pin, the internally threaded hole being configured to mesh an external thread of the bolt.

10. A retaining pin assembly adapted to prevent a ground engaging tool of a work implement from falling off of an adapter on the work implement side, comprising:

a retaining pin that is inserted into a first through-hole in the ground engaging tool and a second through-hole in the adapter disposed so as to pass through the adapter and the ground engaging tool in a state in which the ground engaging tool is in contact with the adapter, the retaining pin being a metal rod;

a metal bushing that is a cylindrical member having an outside diameter that is larger than an outside diameter of the retaining pin, the retaining pin being inserted in an inside of the cylindrical member, which is disposed at an end portion of the retaining pin inside the first through-hole; and a metal retainer at both end portions of the retaining pin that prevents the bushing from coming loose from both end portions of the retaining pin, wherein the bushing is disposed in a state that allows movement in an axial direction of the retaining pin between the adapter and the retainer on an outer peripheral face of the retaining pin.

* * * * *